US007742015B2

(12) United States Patent
Tada et al.

(10) Patent No.: US 7,742,015 B2
(45) Date of Patent: Jun. 22, 2010

(54) LIQUID CRYSTAL DISPLAY DEVICE

(75) Inventors: Masahiro Tada, Kita-ku (JP); Yoshiaki Nakazaki, Saitama (JP); Akihiko Saitoh, Saitama (JP); Hiroyuki Kimura, Fukaya (JP); Shinichi Hirota, Fukaya (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 885 days.

(21) Appl. No.: 11/544,563

(22) Filed: Oct. 10, 2006

(65) Prior Publication Data

US 2007/0091039 A1 Apr. 26, 2007

(30) Foreign Application Priority Data

Oct. 21, 2005 (JP) ..... 2005-307300
Sep. 8, 2006 (JP) ..... 2006-244153

(51) Int. Cl.
*G09G 3/18* (2006.01)

(52) U.S. Cl. ..... 345/52; 345/87

(58) Field of Classification Search ..... 345/84–111, 345/204–215, 690–699, 30–83
See application file for complete search history.

(56) References Cited

U.S. PATENT DOCUMENTS 4,298,866 A * 11/1981 Hodemaekers ..... 345/101
4,390,874 A * 6/1983 Woodside et al. ..... 345/101
5,581,273 A * 12/1996 Yoneda et al. ..... 345/90
6,657,509 B1 * 12/2003 Ohannes ..... 331/177 V
7,489,295 B2 * 2/2009 Honbo ..... 345/102
7,498,858 B2 * 3/2009 Desai et al. ..... 327/246
2005/0036078 A1 * 2/2005 Tsunashima et al. ..... 349/38
2005/0259090 A1 * 11/2005 Wang et al. ..... 345/204
2006/0221015 A1 * 10/2006 Shirasaki et al. ..... 345/77
2008/0062341 A1 * 3/2008 Tanaka ..... 349/38
2008/0252804 A1 * 10/2008 Saitoh et al. ..... 349/39

FOREIGN PATENT DOCUMENTS

JP 2001-255851 9/2001

OTHER PUBLICATIONS

U.S. Appl. No. 12/054,887, filed Mar. 25, 2008, Saitoh, et al.

* cited by examiner

*Primary Examiner*—Alexander Eisen
*Assistant Examiner*—Patrick Marinelli
(74) *Attorney, Agent, or Firm*—Oblon, Spivak, McClelland, Maier & Neustadt, L.L.P.

(57) ABSTRACT

In order to prevent a gradation shift due to variations in the thickness of a film used to form an auxiliary capacitor, a detection capacitor having a layer structure similar to that of the auxiliary capacitor placed for each pixel is provided on an array substrate. Furthermore, the capacitor value of the detection capacitor as a representative of the plurality of auxiliary capacitors is detected, and the potential amplitude ΔVcs of a power supply line connected to the auxiliary capacitor is adjusted based on this detected value.

5 Claims, 14 Drawing Sheets

LIQUID CRYSTAL DISPLAY DEVICE

CROSS-REFERENCE TO RELATED APPLICATIONS

This application is based upon and claims the benefit of priority from Japanese Patent Applications No. 2005-307300 filed on Oct. 21, 2005 and No. 2006-244153 filed on Sep. 8, 2006; the entire contents of which are incorporated herein by reference.

BACKGROUND OF THE INVENTION

1. Field of the Invention

The present invention relates to an active-matrix liquid crystal display device including a switch element, an auxiliary capacitor, and a pixel electrode for each pixel.

2. Description of the Related Art

In recent years, active-matrix liquid crystal display devices have been developed actively. A liquid crystal display device of this type includes a switch element, an auxiliary capacitor, and a pixel electrode for each of segments bordered by a plurality of signal lines and a plurality of scan lines.

As the switch element, for example, a MOS thin-film transistor (TFT) is used. A gate terminal of the TFT is connected to the scan line, a source terminal thereof is connected to the signal line, and a drain terminal thereof is connected to one terminal of the auxiliary capacitor and the pixel electrode. The other terminal of the auxiliary capacitor is connected to a power supply line.

The switch element, the auxiliary capacitor, and the pixel electrode are usually formed on a translucent array substrate. A counter substrate is placed to face the array substrate with a liquid crystal layer interposed therebetween. The pixel electrode on the array substrate and a counter electrode on the counter substrate are placed to face each other with the liquid crystal layer interposed therebetween.

When a scan signal comes in through the scan line, the switch element is turned on, and a video signal voltage which has come in through the signal line is applied through the switch element to the auxiliary capacitor and the pixel electrode. At this time, the potential of the power supply line connected to the auxiliary capacitor is varied. This variation redistributes the charge of the auxiliary capacitor, and determines the voltage to be applied to the pixel electrode. A system in which the voltage on the pixel electrode is determined in this way is called a capacitively coupled drive system. As a liquid crystal display device of this type, for example, one described in Japanese Unexamined Patent Publication No. 2001-255851 is known.

Liquid crystal display devices have wide-ranging uses. In particular, in mobile terminals, there are strong needs for higher definition and higher luminance. In order to sharply display an image such as a photograph, it is required that there be no variations in the gradation-luminance characteristic of a liquid crystal panel.

However, the capacitively coupled drive system has the problem that a gradation shift is prone to occur due to variations in the thickness of a film used to form the auxiliary capacitor.

SUMMARY OF THE INVENTION

An object of the present invention is to prevent a gradation shift due to variations in the thickness of a film used to form an auxiliary capacitor.

A first aspect of the present invention is a liquid crystal display device including: a display section including a switch element, an auxiliary capacitor, and a pixel electrode for each of segments bordered by a plurality of scan lines and a plurality of signal lines; a detection capacitor having a layer structure similar to that of the auxiliary capacitor; a detector configured to detect a capacitor value of the detection capacitor; and an adjuster configured to adjust a potential amplitude of a power supply line connected to the auxiliary capacitor based on the capacitor value detected by the detector.

In this aspect, the detection capacitor having a layer structure similar to that of the auxiliary capacitor is provided, the capacitor value of the detection capacitor as a representative of the plurality of auxiliary capacitors is detected, and the potential amplitude of the power supply line connected to the auxiliary capacitor is adjusted based on this capacitor value. Consequently, since variations in the capacitor value of the auxiliary capacitor correspond to variations in the film thickness of the auxiliary capacitor, a gradation shift due to film thickness variations can be prevented using a simple configuration, and a stable gradation-luminance characteristic can be obtained.

In a second aspect of the present invention, the adjuster makes the adjustment based on a predetermined relationship between the capacitor value and an adjustment value for the potential amplitude. This makes it possible to realize the adjuster having a simple configuration and to realize an accurate adjustment.

In a third aspect of the present invention, the relationship between the capacitor value and the adjustment value for the potential amplitude is linear. Thus, the influence of variations in the capacitor value can be accurately prevented.

In a fourth aspect of the present invention, the adjuster makes an adjustment only in a case where the detected capacitor value is larger than a predetermined value. The predetermined value is a value at which the influence of the auxiliary capacitor on variations becomes larger than that of a liquid crystal capacitor. Thus, while maximum gradation variations are reduced, an unnecessary adjustment of the auxiliary capacitor can be omitted in a range in which the influence of the liquid crystal capacitor is larger.

A fifth aspect of the present invention is the liquid crystal display device further including: a liquid crystal layer; a counter electrode placed to face the pixel electrode with the liquid crystal layer interposed therebetween; a detection capacitor formed between the pixel electrode and the counter electrode for detection of capacitor variations in the liquid crystal layer; a detector configured to detect a capacitor value of this detection capacitor; and an adjuster configured to adjust the potential amplitude of the power supply line connected to the auxiliary capacitor based on the capacitor value detected by this detector.

In this aspect, like the liquid crystal layer, the detection capacitor used to detect capacitor variations in the liquid crystal layer is provided between the pixel electrode and the counter electrode, and the potential amplitude of the power supply line connected to the auxiliary capacitor is adjusted based on the capacitor value of this detection capacitor. Thus, a gradation shift due to variations in the liquid crystal capacitor can also be prevented.

A sixth aspect of the present invention is a display device including: a display section including a switch element, an auxiliary capacitor, and a pixel electrode for each of segments bordered by a plurality of scan lines and a plurality of signal lines; a first oscillator including a detection capacitor having a layer structure similar to that of the auxiliary capacitor; a first frequency counter configured to count an output frequency of the first oscillator; a first register configured to store the counted frequency; a converter configured to convert the stored frequency into the adjustment value on the basis of a predetermined relationship between the output frequency of the first oscillator and an adjustment value for a potential amplitude of the auxiliary capacitor; and an adjuster configured to adjust a potential amplitude of a power supply line connected to the auxiliary capacitor based on the resultant converted adjustment value.

In this aspect, the output frequency of the first oscillator including the detection capacitor having a layer structure similar to that of the auxiliary capacitor is detected, and the potential amplitude of the power supply line connected to the auxiliary capacitor is adjusted based on this frequency. Consequently, since variations in the frequency of the first oscillator correspond to variations in the film thickness of the auxiliary capacitor, a gradation shift due to film thickness variations can be prevented using a simple configuration, and a stable gradation-luminance characteristic can be obtained.

In a seventh aspect of the present invention, the first oscillator is a circuit made by cascading an odd number of inverters in a loop. Each inverter includes thin-film transistors having the detection capacitor.

An eighth aspect of the present invention is the display device further including: a resistor connected between an output terminal of the inverter and an input terminal of the next inverter; and a detection capacitor placed between the input terminal of the inverter and a power supply wire. This detection capacitor has a layer structure similar to that of the auxiliary capacitor.

A ninth aspect of the present invention is the display device further including: a second oscillator including an odd number of inverters cascaded in a loop; a resistor connected between the output terminal of the inverter and an input terminal of the next inverter; and a reference capacitor between the input terminal of the inverter and a power supply wire. Each inverter includes a thin-film transistor having a detection capacitor having a layer structure similar to that of the auxiliary capacitor, and the reference capacitor has a structure different from that of the detection capacitor. The display device of the ninth aspect further includes: a second frequency counter configured to count an output frequency of the second oscillator; a second register configured to store the frequency counted by the second frequency counter; and a difference calculator configured to calculate a difference between the frequencies stored in the first and second registers. Based on a predetermined relationship between a difference between the output frequencies of the first and second oscillators and an adjustment value for the potential amplitude of the auxiliary capacitor, the converter converts the frequency difference calculated by the difference calculator into the adjustment value.

In this aspect, the difference between the output frequency of the first oscillator including the detection capacitor having a layer structure similar to that of the auxiliary capacitor and the output frequency of the second oscillator including the reference capacitor having a structure different from that of the detection capacitor is converted into the adjustment value based on the predetermined relationship. Thus, the potential amplitude of the power supply line connected to the auxiliary capacitor can be adjusted using the frequency difference in which the influence of characteristics of the thin-film transistors constituting the first oscillator and other parasitic capacitors are eliminated, and a more stable gradation-luminance characteristic can be obtained.

In a tenth aspect of the present invention, the detection capacitor contains an impurity in a channel at a concentration set between 1E19 atoms/$cm^3$ and 1E22 atoms/$cm^3$.

In this aspect, since an impurity is contained in the channel of the detection capacitor at a concentration of 1E19 atoms/$cm^3$ to 1E22 atoms/$cm^3$, the operation of the first oscillator and/or the second oscillator can be stabilized.

DESCRIPTION OF THE EMBODIMENTS

First Embodiment

Figure 1:
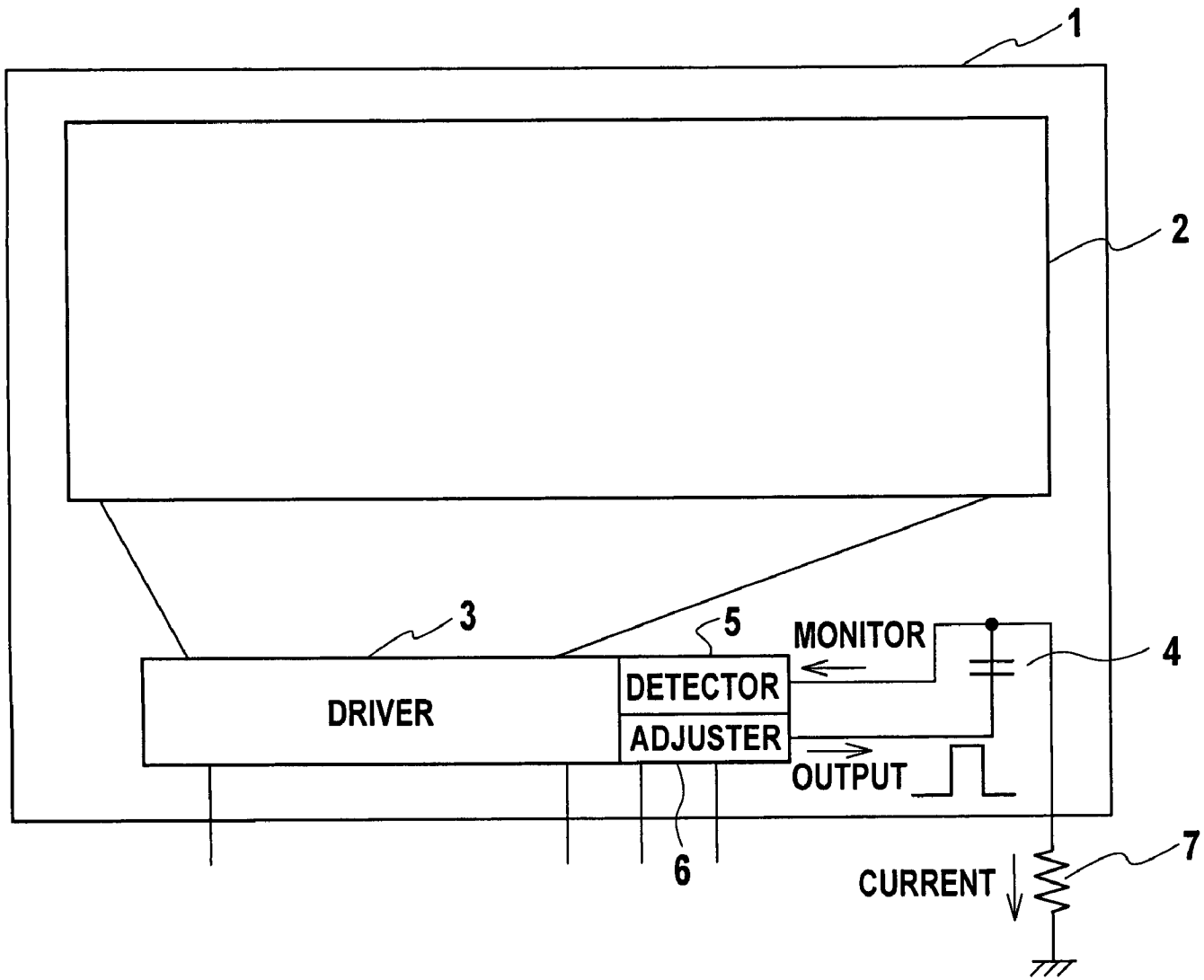
FIG. 1 shows a schematic block diagram of a liquid crystal display device of a first embodiment.

As shown in the schematic block diagram of FIG. 1, a liquid crystal display device of this embodiment includes an array substrate 1 in which a display section 2, a driver 3, and a detection capacitor 4 are formed on a translucent substrate. In order to enable transistors of each circuit to be formed on the translucent substrate, thin-film transistors (TFT) are employed as the transistors of each circuit. Moreover, a detector 5 and an adjuster 6 are made of IC chips and mounted on the array substrate 1. It should be noted that the detector 5 and the adjuster 6 may be formed on the translucent substrate.

Figure 2:
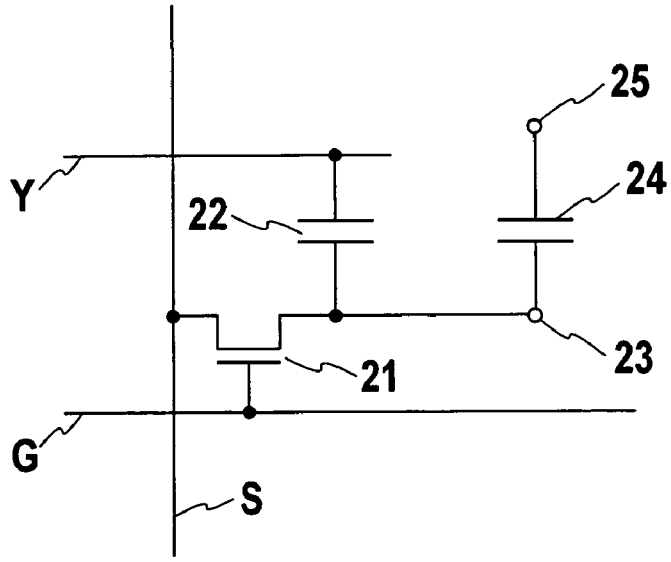
FIG. 2 shows an equivalent circuit diagram of one pixel of the liquid crystal display device.

In the display section 2, a plurality of scan lines and a plurality of signal lines are routed so as to intersect each other. A pixel is placed for each of segments bordered by the scan lines and the signal lines. As shown in the circuit diagram of FIG. 2, each pixel includes a switch element 21, an auxiliary capacitor 22, a pixel electrode 23, a liquid crystal capacitor (capacitor of a liquid crystal layer) 24, and a counter electrode 25. The switch element 21 is a MOS TFT. A gate terminal of the switch element 21 is connected to the scan line G, a source terminal thereof is connected to the signal line S, and a drain terminal thereof is connected to one terminal of the auxiliary capacitor 22 and the pixel electrode 23. To the other terminal of the auxiliary capacitor 22, a power supply line Y is connected. A counter substrate including the counter electrode 25 is placed to face the array substrate 1 with the liquid crystal layer interposed therebetween. That is, the pixel electrode 23 on the array substrate 1 and the counter electrode 25 on the counter substrate are placed to face each other with the liquid crystal capacitor 24 interposed therebetween.

The driver 3 is a circuit configured to drive the scan lines and the signal lines. It should be noted that a scan line driver and a signal line driver may be integrally formed as one driver as shown in FIG. 1 or may be separately formed. Furthermore, the adjuster 6 may be incorporated into the driver 3.

Figure 3:
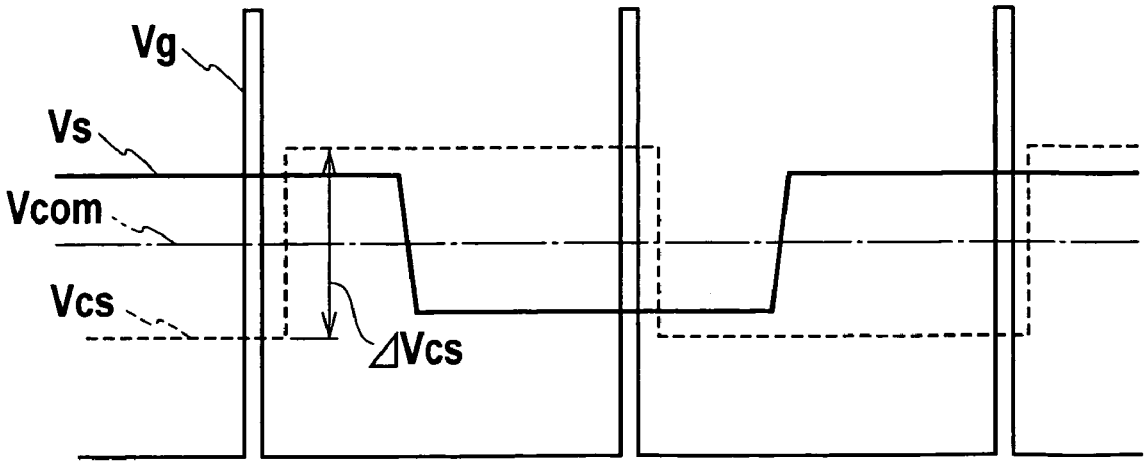
FIG. 3 shows a voltage waveform at each portion of the pixel.

Here, the operation of the pixel when the scan line and the signal line have been driven will be described using the waveform diagram of FIG. 3. In FIG. 3, Vs is a video signal voltage on the signal line S, Vg is a scan signal voltage on the scan line G, Vcs is the voltage across the auxiliary capacitor 22, and Vcom is the voltage on the counter electrode 25. The voltage Vcom on the counter electrode 25 is assumed to be constant.

When the scan signal voltage Vg temporarily rises to a high level at the first timing, the video signal voltage Vs at this time is applied to the auxiliary capacitor 22, and the auxiliary capacitor voltage Vcs is determined by the video signal voltage Vs and the voltage on the power supply line Y. In this drawing, a state is shown in which the auxiliary capacitor voltage Vcs is raised. Then, when the scan signal voltage Vg temporarily rises to a high level at the second timing, the video signal voltage Vs at this time is applied to the auxiliary capacitor 22, and the auxiliary capacitor voltage Vcs is again determined by the video signal voltage Vs and the voltage on the power supply line Y. In this drawing, a state is shown in which the auxiliary capacitor voltage Vcs is lowered. Thus, the voltage Vcs across the auxiliary capacitor 22 has an amplitude ΔVcs according to the video signal voltage Vs and the voltage on the power supply line Y.

Referring back to FIG. 1, the detection capacitor 4 is a capacitor having a layer structure similar to that of the auxiliary capacitor 22. This detection capacitor 4 is formed on the array substrate 1 simultaneously with the auxiliary capacitor 22 by the same manufacturing process. Furthermore, to the detection capacitor 4, one terminal of a resistor 7 is connected. The other terminal of the resistor 7 is grounded.

The detector 5 detects the capacitor value of the detection capacitor 4. Specifically, when this liquid crystal display device is started, a fixed potential is applied to the detection capacitor 4; the potential at the time when the charge stored in this detection capacitor 4 is discharged through the resistor 7, and the period of time until this potential decreases to a fixed value, are monitored; and the capacitor value is found based on these measured values. At this time, placing an accurate resistor as the resistor 7 outside the array substrate makes it possible to accurately monitor the potential change of the detection capacitor. The reason for finding the capacitor value in this way is that variations in the film thickness of the auxiliary capacitor have a relationship with variations in the capacitor value.

Based on the capacitor value detected by the detector 5, the adjuster 6 adjusts the potential amplitude of the power supply line Y connected to the auxiliary capacitor 22. A method for the adjustment will be described below.

Figure 4:
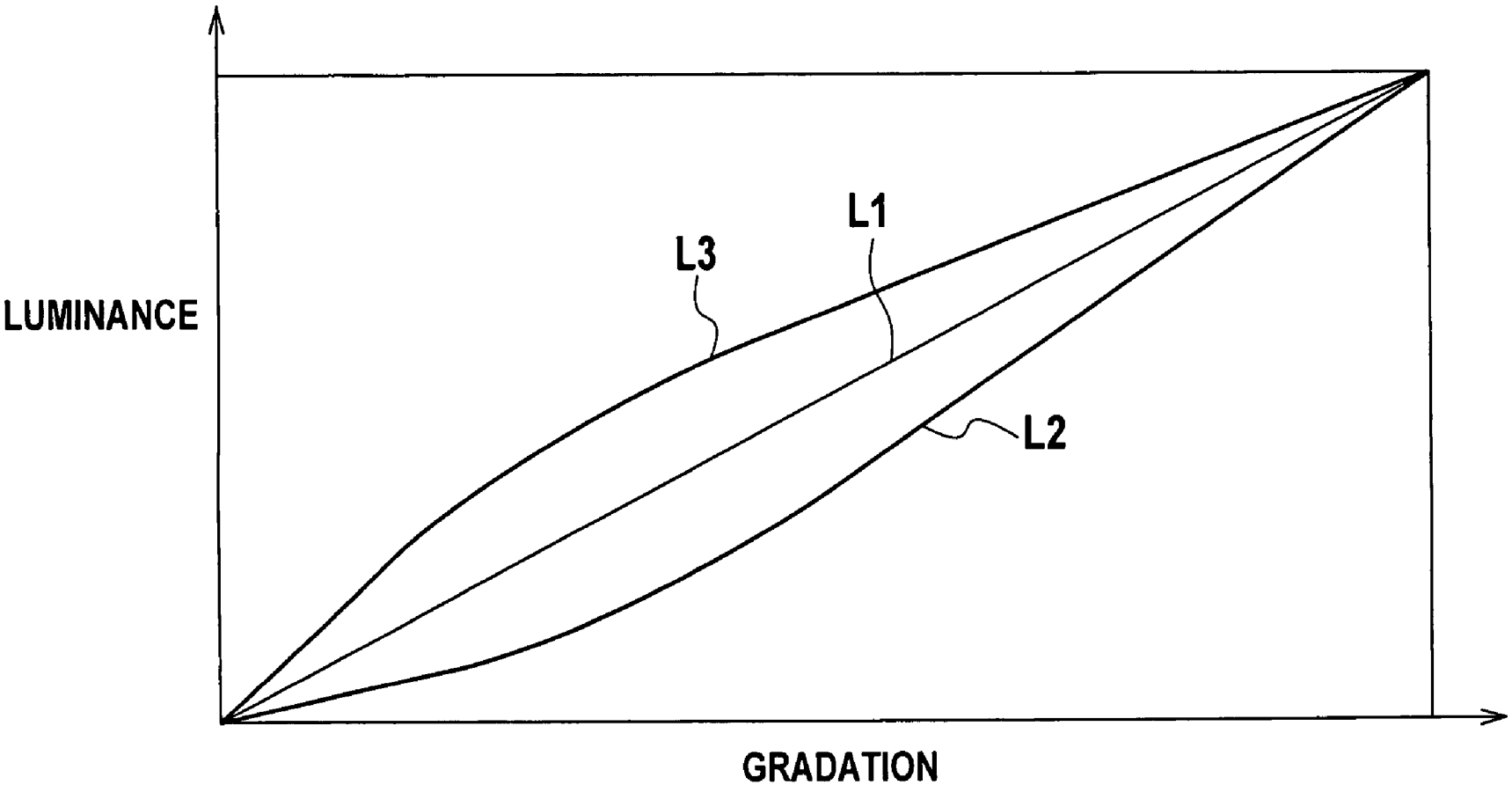
FIG. 4 shows a graph of gradation-luminance characteristics.

FIG. 4 is a graph showing gradation-luminance characteristics. In this drawing, an ideal characteristic is represented by reference line L1. In the case where the capacitor value Ccs detected by the detector 5 is large, the potential change ΔV of the power supply line Y when the auxiliary capacitor voltage Vcs is inverted is large. In the case of a normally white mode in which light passes through to provide a high luminance when no voltage is applied, when the potential change ΔV increases, the luminance shifts to lower values as represented by curved line L2 of FIG. 4. This is because the potential change ΔV is determined by the following equation:

$$\Delta V = \Delta Vcs \times Ccs / Ctotal \quad (1)$$

Here, Ctotal is the total capacitor including the auxiliary capacitor Ccs, the liquid crystal capacitor Ccl, and a parasitic capacitor Ctft of the TFT, and is represented by the following equation:

$$Ctotal = Ccs + Ccl + Ctft + \quad (2)$$

The potential change ΔV is determined as represented by equation (1). Accordingly, in the case where the detected capacitor value Ccs is large, the adjuster adjusts the potential amplitude ΔVcs of the power supply line Y connected to the auxiliary capacitor 22 downward, thus increasing the luminance. On the other hand, in the case where the detected capacitor value Ccs is small, the luminance shifts to higher values as represented by curved line L3 of FIG. 4. Accordingly, the potential amplitude ΔVcs is adjusted upward, thus lowering the luminance.

Figure 5:
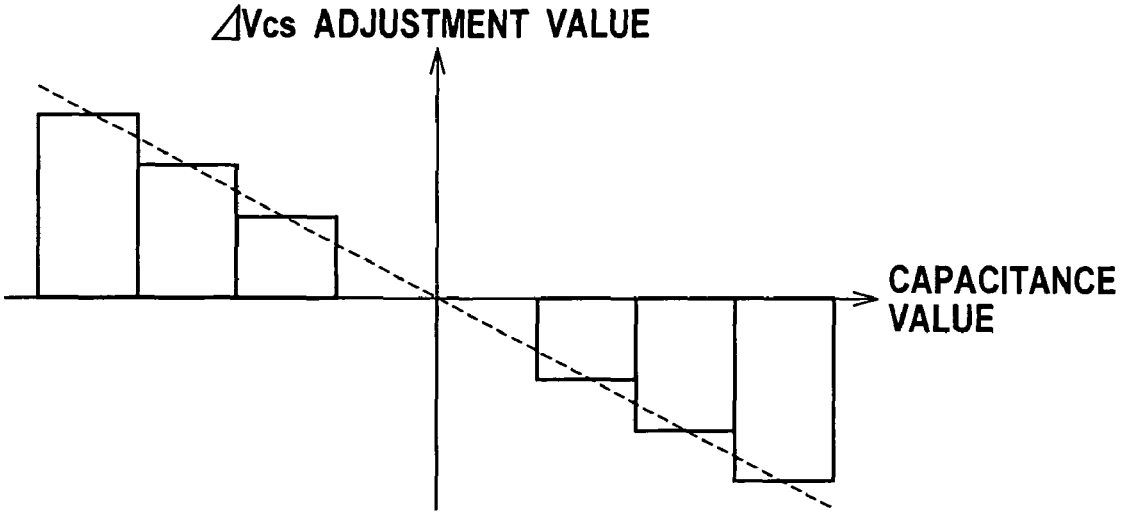
FIG. 5 is a graph showing a relationship between the capacitor value of a detection capacitor and an adjustment value for the potential amplitude of an auxiliary capacitor.

FIG. 5 is a graph showing a relationship between the capacitor value of the detection capacitor 4 which is detected by the detector 5 and an adjustment value for the potential amplitude ΔVcs of the auxiliary capacitor 22. Such a relationship is beforehand determined, and the adjuster 6 makes an adjustment based on this relationship. For example, in the case where variations in the film thickness of the auxiliary capacitor are in the range of approximately ±10% for a pixel capacitor of 1 pF, the potential amplitude ΔVcs of the auxiliary capacitor needs to be adjusted within the range of ±0.2 V at the maximum. Accordingly, in consideration of this, such a relationship is determined. In a specific circuit configuration, such adjustment values are set in registers or the like, and an adjustment value corresponding to a capacitor value detected is selected to be outputted.

The potential amplitude ΔVcs of the auxiliary capacitor is desirably adjusted with a linear relationship with the detected capacitor value maintained. This is particularly effective in the case where the auxiliary capacitor Ccs is sufficiently larger than the liquid crystal capacitor Ccl.

However, in practice, variations in the gradation characteristic fluctuate due to not only the film thickness of the auxiliary capacitor but also other factors such as the thickness of the liquid crystal layer (cell gap). This is because factors determining the potential fluctuation ΔV include the liquid crystal capacitor Ccl as represented by equations (1) and (2).

Figure 6:
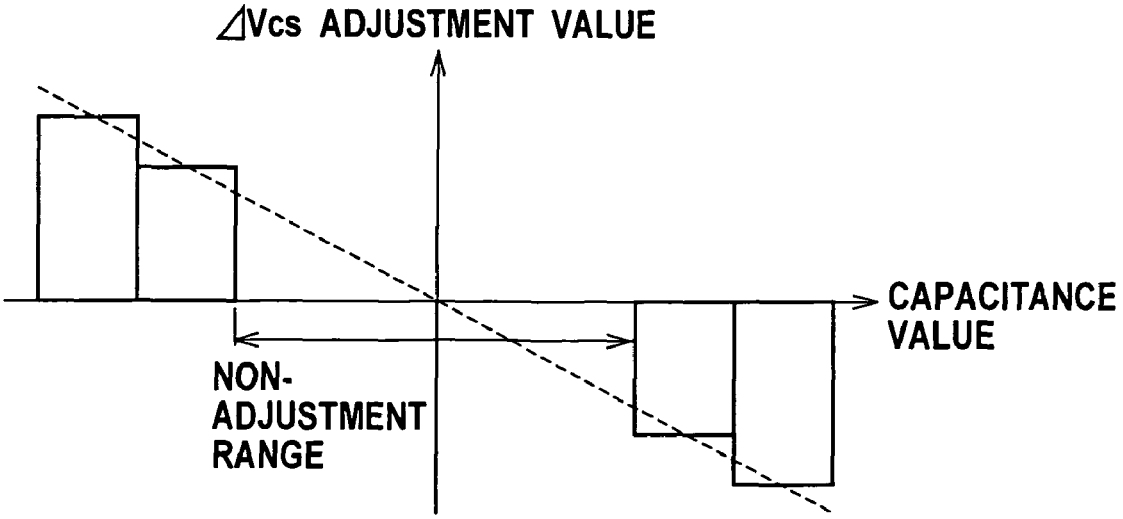
FIG. 6 is a graph showing a relationship between the capacitor value of the detection capacitor and the adjustment value for the potential amplitude of the auxiliary capacitor and showing a non-adjustment range.

For this reason, adjustment values are beforehand determined only in ranges in which the detected auxiliary capacitor deviating to some great extent is as shown in the graph of FIG. 6 when the auxiliary capacitor Ccs is not sufficiently large relative to the liquid crystal capacitor Ccl in the case of a high-definition pixel or the like. Furthermore, an adjustment is made only in the case where the detected capacitor value is larger than a predetermined value. The predetermined value is set to a value at which the influence of the auxiliary capacitor on variations becomes larger than that of the liquid crystal capacitor. Thus, an unnecessary adjustment can be omitted in a range in which the influence of the liquid crystal capacitor Ccl is larger, and, on the other hand, maximum gradation variations can be reduced.

Moreover, in order to eliminate the influence of fluctuations in the liquid crystal capacitor Ccl, the following may be employed. First, a detection capacitor used to detect variations in the liquid crystal capacitor is provided between the pixel electrode 23 and the counter electrode 25. This detection capacitor has a layer structure similar to that of the liquid crystal layer. Furthermore, the capacitor value of this detection capacitor is detected by a detector, and the potential amplitude ΔVcs of the auxiliary capacitor is adjusted based on this capacitor value by an adjuster. As the processing in the detector and the adjuster, processing similar to the aforementioned one is employed.

Thus, in this embodiment, the detection capacitor 4 having a layer structure similar to that of the auxiliary capacitor 22 placed for each pixel is provided, the capacitor value of the detection capacitor 4 as a representative of the plurality of auxiliary capacitors 22 is detected, and the potential amplitude ΔVcs of the power supply line Y connected to the auxiliary capacitor 22 is adjusted based on this capacitor value. Since variations in the capacitor value of the auxiliary capacitor 22 correspond to variations in the film thickness of the auxiliary capacitor, a gradation shift due to film thickness variations can be prevented using a simple configuration. Accordingly, a stable gradation-luminance characteristic can be obtained.

In this embodiment, the adjuster 6 adjusts the potential amplitude ΔVcs based on a predetermined relationship between the capacitor value of the detection capacitor 4 and an adjustment value for the potential amplitude ΔVcs of the auxiliary capacitor 22. This makes it possible to realize the adjuster 6 having a simple configuration and realize an accurate adjustment. In particular, in the case where the auxiliary capacitor Ccs is sufficiently larger than the liquid crystal capacitor Ccl, the influence of capacitor variations in the auxiliary capacitor Ccs can be accurately prevented by determining the relationship therebetween so that it becomes linear.

In this embodiment, in the case where the auxiliary capacitor Ccs is not sufficiently larger than the liquid crystal capacitor Ccl, the adjuster 6 adjusts the potential amplitude ΔVcs only when the capacitor value detected by the detector 5 is larger than a predetermined value. Thus, while maximum gradation variations are reduced, an unnecessary adjustment of the auxiliary capacitor Ccs can be omitted in a range in which the influence of the liquid crystal capacitor Ccl is large.

In this embodiment, variations in the liquid crystal capacitor can also be eliminated by providing a detection capacitor used to detect variations in the liquid crystal capacitor Ccl between the pixel electrode 23 and the counter electrode 25 in the same manner as providing the liquid crystal layer, and by adjusting the potential amplitude ΔVcs of the power supply line Y connected to the auxiliary capacitor 22 based on the capacitor value of this detection capacitor. Thus, a more stable gradation-luminance characteristic can be obtained. It should be noted that a detector and an adjuster for the liquid crystal capacitor may be the detector 5 and the adjuster 6 for the auxiliary capacitor or may be formed separately from these.

In this embodiment, since the adjuster 6 is incorporated into the driver 3 and this driver 3 is formed on the translucent substrate, a favorable gradation characteristic can be obtained without increasing the outer dimensions of the liquid crystal display device.

Second Embodiment

Figure 7:
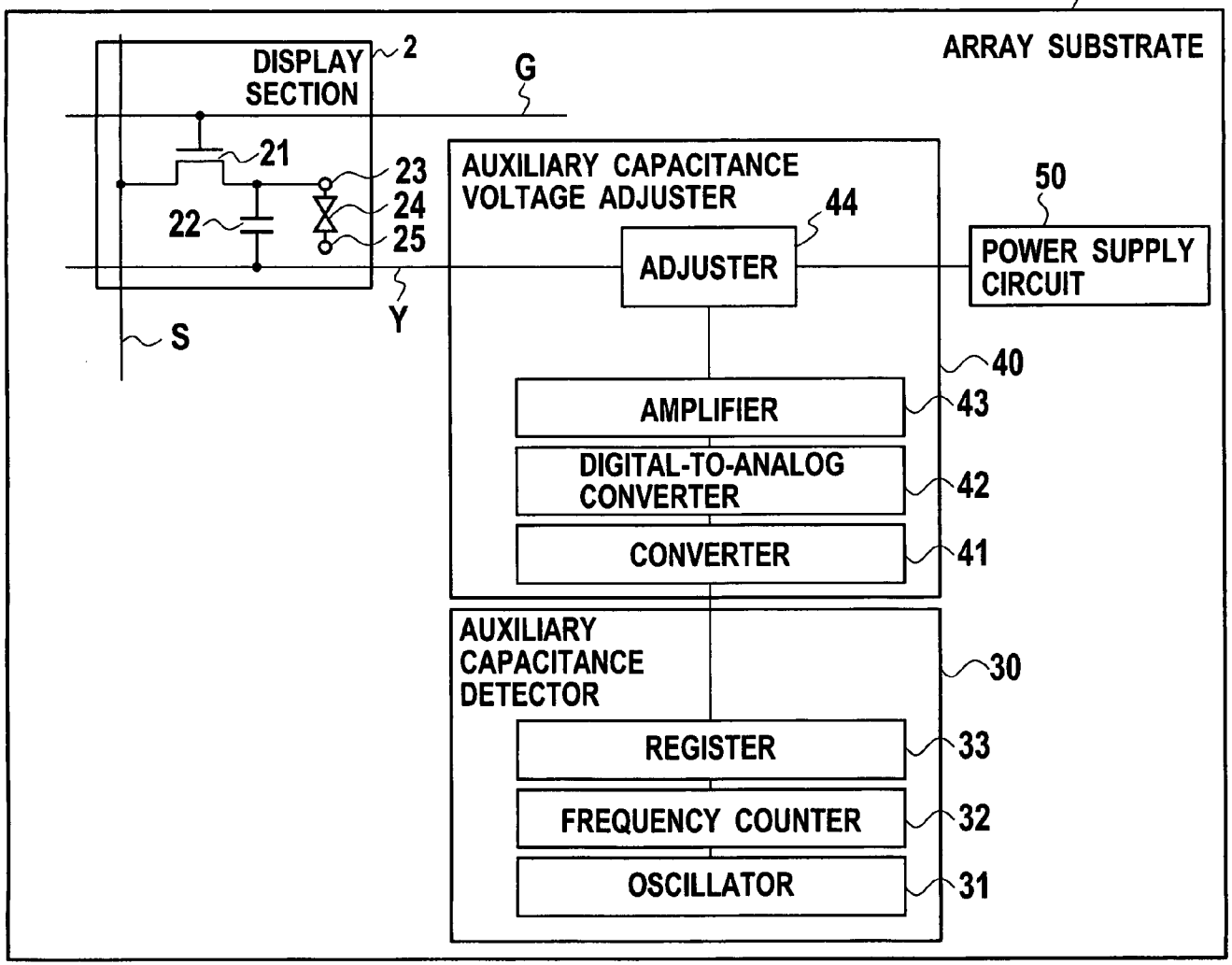
FIG. 7 shows a schematic block diagram of a liquid crystal display device of a second embodiment.

As shown in the schematic block diagram of FIG. 7, in a liquid crystal display device of a second embodiment, an array substrate 100 includes the display section 2, an auxiliary capacitor detector 30, an auxiliary capacitor voltage adjuster 40, and a power supply circuit 50 on a translucent substrate. In order to enable transistors of each circuit to be formed on the translucent substrate, thin-film transistors (TFT) are employed as the transistors of each circuit. The basic configuration of the display section 2 is similar to that of the first embodiment.

Figure 8:
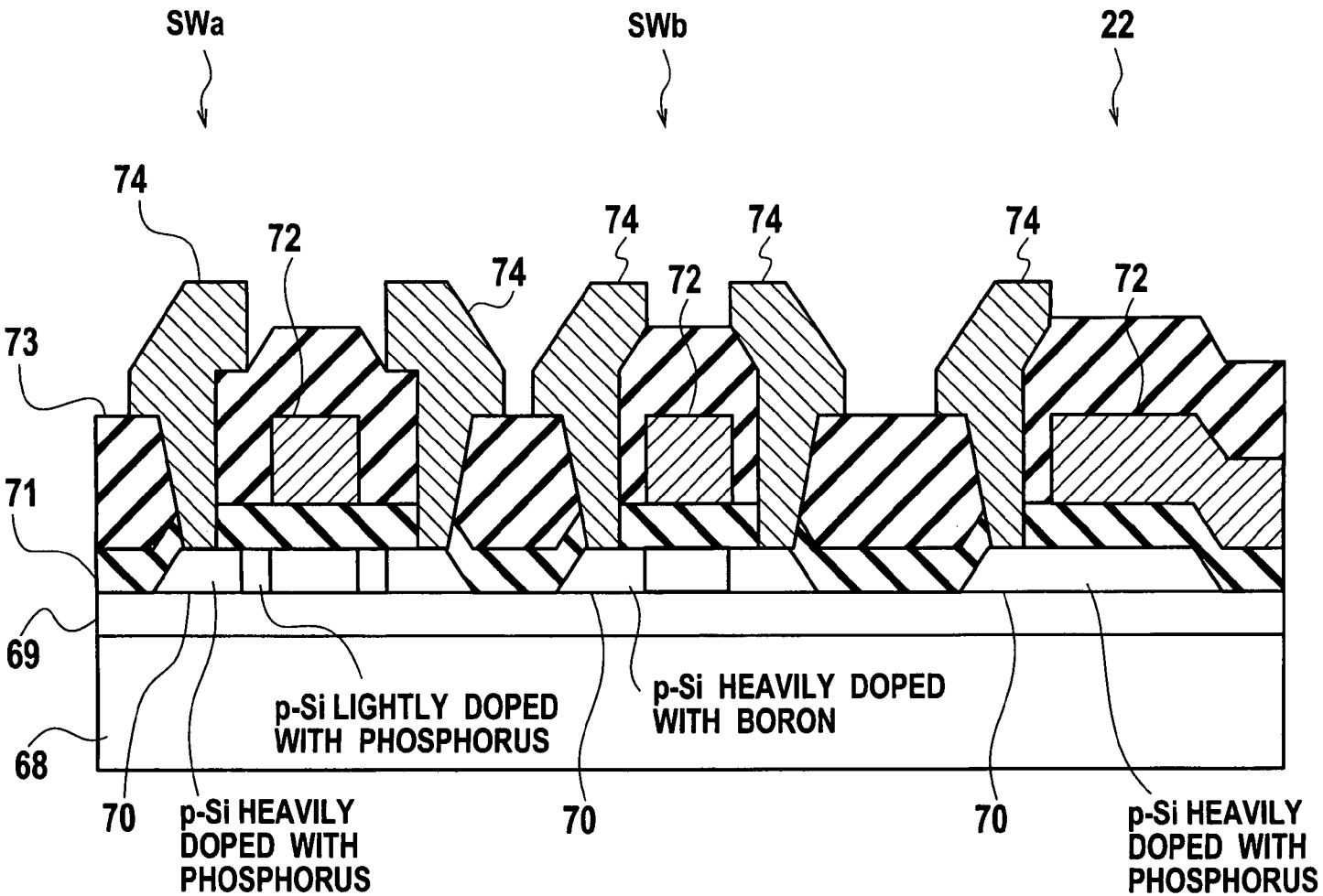
FIG. 8 shows a cross-sectional view of the layer structures of an nMOS thin-film transistor, a pMOS thin-film transistor, and an auxiliary capacitor.

Next, a description will be given of the layer structures of a MOS thin-film transistor constituting the switch element 21 and the auxiliary capacitor 22. As shown in the cross-sectional view of FIG. 8, an nMOS thin-film transistor SWa, a pMOS thin-film transistor SWb, and the auxiliary capacitor 22 have layer structures including gate insulating films 71 of the same thickness. Specifically, a channel 70 made of polysilicon (p-Si), the gate insulating film 71, a gate electrode 72, and an interlayer insulating film 73 are formed on a glass substrate 68 and an undercoat 69, and source/drain electrodes 74 are provided so as to come into contact with the channel 70 through contact holes provided in the gate insulating film 71 and the interlayer insulating film 73. The gate insulating films 71 function as respective dielectrics of the nMOS thin-film transistor SWa, the pMOS thin-film transistor SWb, and the auxiliary capacitor 22 which store charge. Thus, the gate insulating films 71 function as capacitors, and referred to as gate oxide film capacitors.

Each channel 70 contains an impurity, which is phosphorus or boron. In the case of the nMOS thin-film transistor SWa, portions of the channel 70 which are in contact with the source/drain electrodes 74 contain a high concentration of phosphorus, and portions between the contacted portions contain a low concentration of phosphorus. Furthermore, in the case of the pMOS thin-film transistor SWb, portions of the channel 70 which are in contact with the source/drain electrodes 74 contain a high concentration of boron. Moreover, in the case of the auxiliary capacitor 22, the entire region of the channel 70 contains a high concentration of phosphorus.

Figure 9:
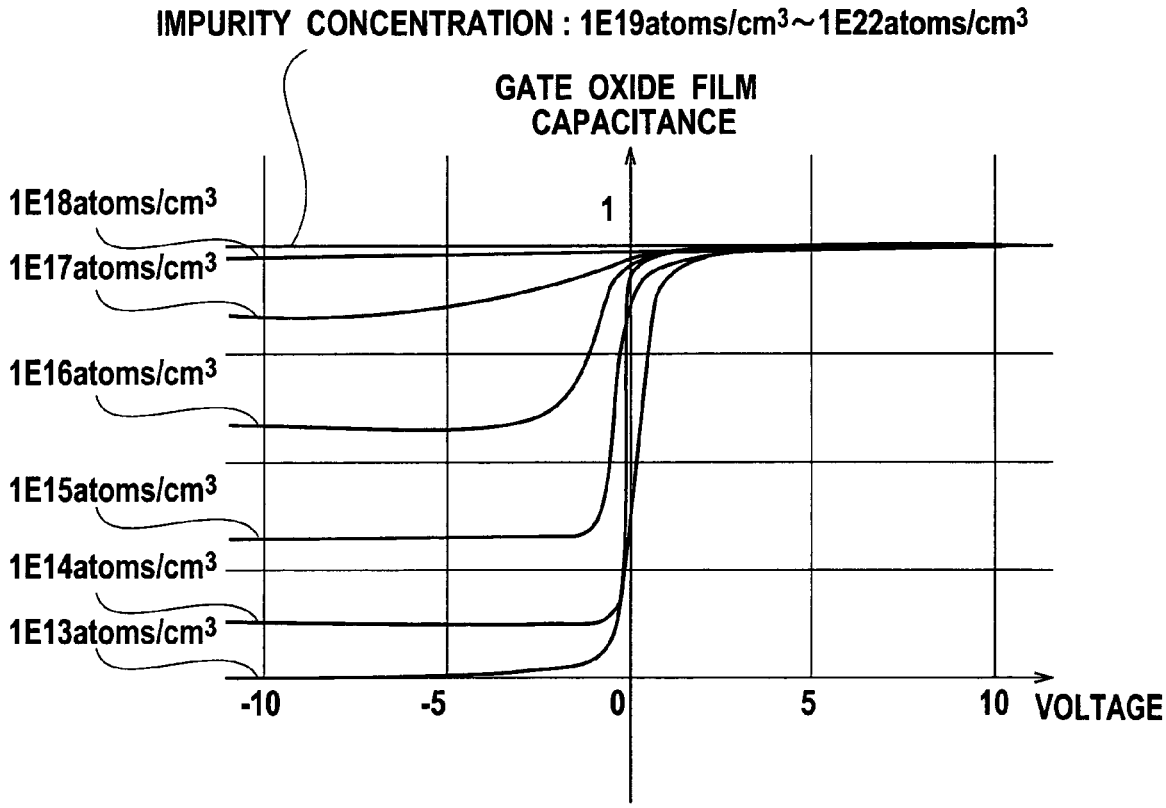
FIG. 9 is a graph showing relationships between voltage and gate oxide film capacitor for different concentrations of an impurity contained in a channel.

FIG. 9 is a graph showing relationships between voltage and gate oxide film capacitor for different concentrations of the impurity contained in the channel 70. In the cases of low impurity concentrations, the gate oxide film capacitor largely depends on a change of the voltage. Accordingly, the operation of the nMOS thin-film transistor SWa, the pMOS thin-film transistor SWb, and the auxiliary capacitor 22 becomes unstable, and this affects the operation of the liquid crystal display device. On the other hand, in the case of high impurity concentrations, the gate oxide film capacitor is approximately constant with respect to the change of the voltage. Thus, voltage dependence is very low. Accordingly, the operation of the nMOS thin-film transistor SWa, the pMOS thin-film transistor SWb, and the auxiliary capacitor 22 can be stabilized by high concentrations of impurities which are set at 1E19 atoms/$cm^3$ to 1E22 atoms/$cm^3$.

Referring back to FIG. 7, the auxiliary capacitor detector 30 includes an oscillator 31, a frequency counter 32, and a register 33. The output frequency of the oscillator 31 is counted by the frequency counter 32, temporarily stored in the register 33, and then transmitted to the auxiliary capacitor voltage adjuster 40.

Figure 10:
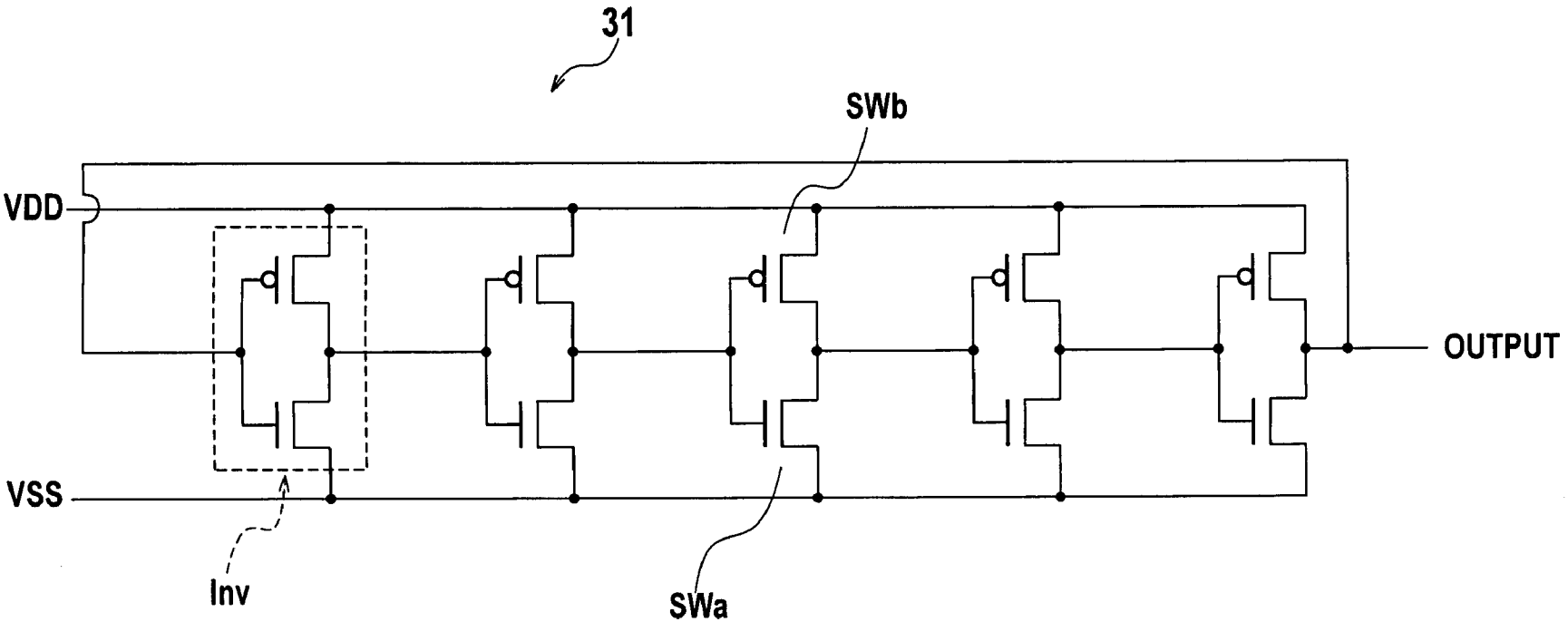
FIG. 10 shows a circuit diagram of an oscillator in FIG. 7.

The oscillator 31 includes MOS thin-film transistors having detection capacitors (gate oxide film capacitors) having layer structures similar to that of the auxiliary capacitor 22. Specifically, as shown in the circuit diagram of FIG. 10, the oscillator 31 is a ring oscillator in which five inverters Inv each made by connecting the nMOS thin-film transistor SWa and the pMOS thin-film transistor SWb shown in FIG. 8 in series are cascaded in a loop. The source electrodes of all of the nMOS thin-film transistors SWa are connected to a power supply VSS, and the source electrodes of all of the pMOS thin-film transistors SWb are connected to a power supply VDD which is supplied with a voltage different from that of the power supply VSS. In the case where a loop of an odd number of inverters is formed, a logical value obtained by inverting a logical value inputted to an input terminal of each inverter is returned to the input terminal. Accordingly, the inversion of the input is endlessly repeated. Thus, the loop operates as an oscillator.

The frequency f of the oscillator 31 configured using a ring oscillator circuit is determined by the following equation:

$$f=1/(2\times\tau_{pd}\times N) \quad (3)$$

where $\tau_{pd}$ is the delay of the inverter Inv, and N is the number of inverters.

The delay $\tau_{pd}$ is determined by the following equation:

$$\tau_{pd}=k\times(1/\mathrm{Ion}(n\text{-}ch)+1/\mathrm{Ion}(p\text{-}ch)) \quad (4)$$

where Ion(n-ch) is the saturation current of the nMOS thin-film transistor, Ion(p-ch) is the saturation current of the pMOS thin-film transistor, and k is a coefficient.

The saturation current Ion of the MOS transistor is determined by the following equation:

$$\mathrm{Ion}=(1/2)\times\mu\times C(W/L)\times(\mathrm{Vgs}-\mathrm{Vth})^2 \quad (5)$$

where μ is the carrier mobility, W is the gate width, L is the gate length, C is the gate oxide film capacitor per unit area, Vgs is the gate voltage, and Vth is the threshold voltage.

Figure 11:
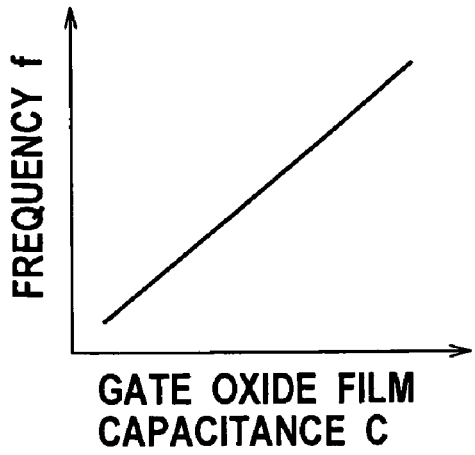
FIG. 11 is a graph showing the relationship between the output frequency of the oscillator of FIG. 10 and the gate oxide film capacitor.

In equation (5), the gate voltage Vgs and the threshold voltage Vth are fixed values. Accordingly, with reference to equations (3) to (5), the frequency f is proportional to the gate oxide film capacitor C. FIG. 11 is a graph showing the relationship between the output frequency f of the oscillator 31 of this embodiment and the gate oxide film capacitor C. The reason for finding the frequency in this way is that variations in the film thickness of the auxiliary capacitor 22 correspond to variations in the output frequency of the oscillator 31. That is, variations in the output frequency of the oscillator 31 correspond to variations in the gate oxide film capacitor as shown in FIG. 11. Since the oscillator 31 is configured using the nMOS thin-film transistors SWa and the pMOS thin-film transistors SWb having the detection capacitors having layer structures similar to that of the auxiliary capacitor 22, variations in the output frequency of the oscillator 31 correspond to variations in the gate oxide film capacitor of the auxiliary capacitor 22, and, as a result, also correspond to variations in the thickness of the gate insulating film 71 of the auxiliary capacitor 22.

Referring back to FIG. 7, the auxiliary capacitor voltage adjuster 40 will be described. The auxiliary capacitor voltage adjuster 40 includes a converter 41, a digital-to-analog converter 42, an amplifier 43, and an adjuster 44, and adjusts the potential amplitude of the power supply line Y connected to the auxiliary capacitor 22 based on the output frequency of the auxiliary capacitor detector 30. A method for the adjustment will be described next.

As represented by equation (2) in the first embodiment, the potential change ΔV is determined. In the case where the frequency detected by the auxiliary capacitor detector 30 is high, the capacitor C is also large proportionately as shown in FIG. 11. Accordingly, the auxiliary capacitor voltage adjuster 40 adjusts the potential amplitude ΔVcs of the power supply line Y connected to the auxiliary capacitor 22 downward, thus increasing the luminance. On the other hand, in the case where the detected frequency is low, the luminance shifts to higher values as represented by curved line L3 of FIG. 4. Accordingly, the potential amplitude ΔVcs is adjusted upward, thus lowering the luminance.

Figure 12:
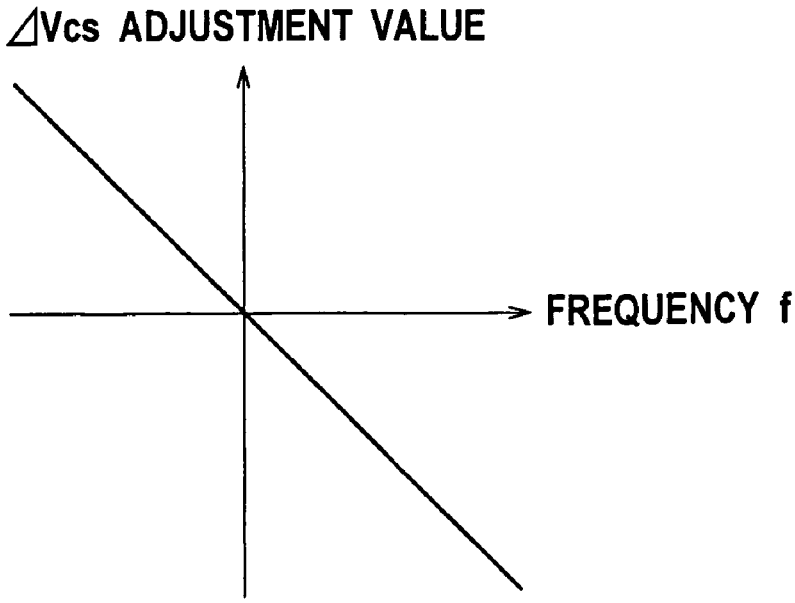
FIG. 12 is a graph showing a relationship between the frequency of the oscillator which is detected by an auxiliary capacitor detector and an adjustment value for the potential amplitude of the auxiliary capacitor.

FIG. 12 is a graph showing a relationship between the frequency f of the oscillator 31 which is detected by the auxiliary capacitor detector 30 and an adjustment value for the potential amplitude ΔVcs of the auxiliary capacitor 22. Such a relationship is beforehand determined in a translation table, and the auxiliary capacitor voltage adjuster 40 makes an adjustment based on this relationship. The adjuster 41 converts the frequency stored in the register 33 into a potential amplitude ΔVcs based on this translation table. The resultant potential amplitude ΔVcs is converted into an analog signal by the digital-to-analog converter 42 and then amplified by the amplifier 43 by a predetermined factor to be transmitted to the adjuster 44. The adjuster 44 adjusts the potential amplitude of the power supply line Y connected to the auxiliary capacitor 22 based on the potential amplitude ΔVcs of the resultant converted analog signal.

It should be noted that a method of adjusting the potential amplitude of the power supply line Y using an adjustment value for the potential amplitude ΔVcs is not limited to this. For example, the potential amplitude ΔVcs can be converted into an analog signal by the digital-to-analog converter 42 after amplified by the amplifier 43. The analog signal obtained through the conversion by the digital-to-analog converter 42 can also be transmitted to the adjuster 44 without involving the amplifier 43. Moreover, the adjuster 44 can not only add the adjustment value to the potential amplitude of the power supply line Y but also use a subtraction, a multiplication, a division, or the like.

In this embodiment, the output frequency of the oscillator 31 including the nMOS thin-film transistors SWa and the pMOS thin-film transistors SWb having the detection capacitors having layer structures similar to that of the auxiliary capacitor 22 is detected, and the potential amplitude of the power supply line Y connected to the auxiliary capacitor 22 is adjusted based on this frequency. Consequently, since variations in the frequency of the oscillator 31 correspond to variations in the film thickness of the auxiliary capacitor 22, a gradation shift due to film thickness variations can be prevented using a simple configuration, and a stable gradation-luminance characteristic can be obtained.

In this embodiment, the auxiliary capacitor voltage adjuster 40 adjusts the potential amplitude ΔVcs based on a predetermined relationship between the output frequency of the oscillator 31 and an adjustment value for the potential amplitude ΔVcs of the auxiliary capacitor 22. This makes it possible to realize the auxiliary capacitor voltage adjuster 40 having a simple configuration and realize an accurate adjustment.

In this embodiment, the channel portions of the nMOS thin-film transistor SWa and the pMOS thin-film transistor SWb contain impurities at concentrations set between 1E19 atoms/$cm^3$ and 1E22 atoms/$cm^3$. Accordingly, the operation of the oscillator 31 can be stabilized.

Figure 13:
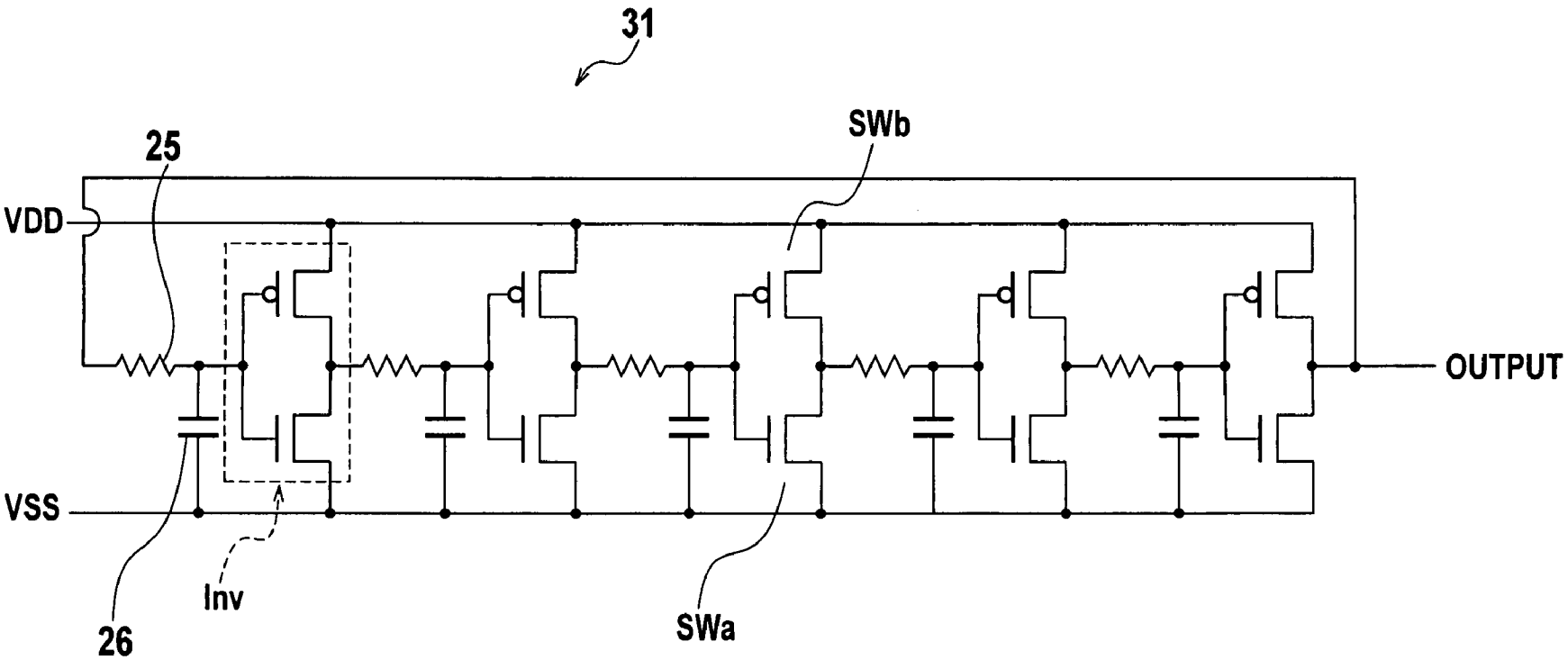
FIG. 13 shows a circuit diagram of an oscillator of a modified example.

Next, a modified example of the oscillator 31 will be described. As shown in the circuit diagram of FIG. 13, the oscillator 31 of the modified example further includes a resistor 25 between the output terminal of each inverter Inv and the input terminal of the next inverter, and a detection capacitor 26 having a layer structure similar to that of the auxiliary capacitor 22 between the input terminal of each inverter Inv and the power supply VSS.

Figure 14:
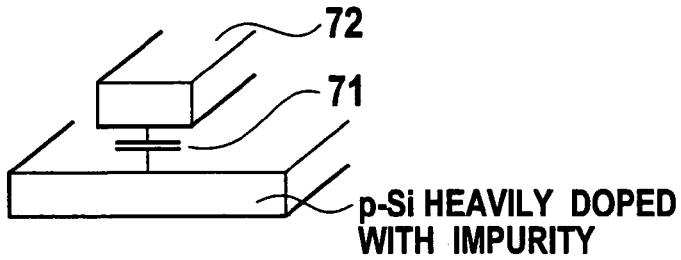
FIG. 14 is a perspective view showing the structure of a detection capacitor.

As shown in the perspective view of FIG. 14, the detection capacitor 26 holds a gate insulating film 71 between a gate electrode 72 and polysilicon containing a high concentration of an impurity. An effect produced in the case where a high concentration of an impurity is contained is similar to the effect described previously. It should be noted that this polysilicon corresponds to the channel 70 of the auxiliary capacitor 22 shown in FIG. 8.

In the case where the delay $\tau_{rc}$ represented by the product of the resistor 25 and the detection capacitor 26 is sufficiently larger than the delay $\tau_{pd}$ of the single inverter, the frequency of the oscillator 31 is determined using the delay $\tau_{rc}$ and the number N of inverters by the following equation:

$$f=1/(2\times\tau_{rc}\times N) \quad (6)$$

The delay $\tau_{rc}$ is proportional to the thickness of the gate insulating film 71 of the detection capacitor 26. Accordingly, with reference to equation (6), the frequency f is inversely proportional to the gate oxide film capacitor C of the detection capacitor 26.

Figure 15:
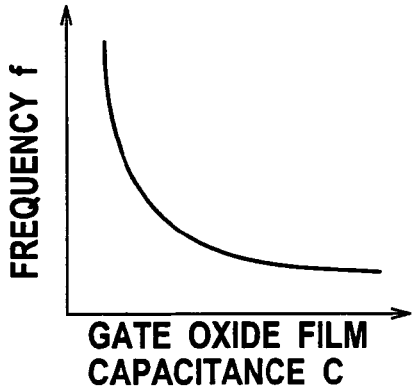
FIG. 15 is a graph showing the relationship between the output frequency of the oscillator of the modified example and the gate oxide film capacitor.
Figure 16:
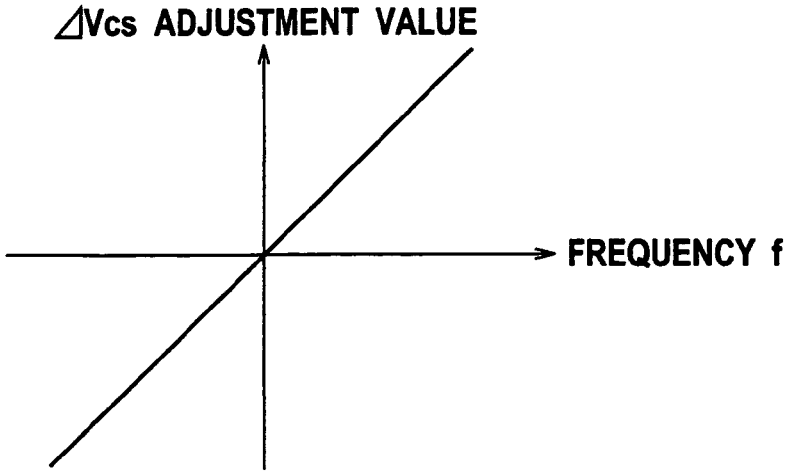
FIG. 16 is a graph showing a relationship between the frequency detected by an auxiliary capacitor detector including the oscillator of the modified example and an adjustment value for the potential amplitude of the auxiliary capacitor.

FIG. 15 is a graph showing the relationship between the output frequency f of the oscillator 31 of this modified example and the gate oxide film capacitor C. As described previously, variations in the film thickness of the auxiliary capacitor 22 correspond to variations in the output frequency of the oscillator 31. Accordingly, determining a relationship between the frequency f detected by the auxiliary capacitor detector 30 including the oscillator 31 of this modified example and an adjustment value for the potential amplitude ΔVcs of the auxiliary capacitor 22 beforehand in a translation table, makes it possible to adjust the potential amplitude of the power supply line Y connected to the auxiliary capacitor 22.

Specifically, in the case where the frequency detected by the auxiliary capacitor detector 30 is high, the capacitor C is small as shown in FIG. 15. Accordingly, the auxiliary capacitor voltage adjuster 40 adjusts the potential amplitude ΔVcs of the power supply line Y connected to the auxiliary capacitor 22 upward, thus lowering the luminance. On the other hand, in the case where the detected frequency is low, the luminance shifts to lower values as represented by curved line L2 of FIG. 4. Accordingly, the potential amplitude ΔVcs is adjusted downward, thus increasing the luminance. Other components and the operation thereof are similar to those described previously, and therefore will not be further described here.

In this modified example, the output frequency of the oscillator 31 having the detection capacitors 26 having layer structures similar to that of the auxiliary capacitor 22 is detected, and the potential amplitude of the power supply line Y connected to the auxiliary capacitor 22 is adjusted based on this frequency. Consequently, since variations in the frequency of the oscillator 31 correspond to variations in the film thickness of the auxiliary capacitor 22, a gradation shift due to film thickness variations can be prevented using a simple configuration, and a stable gradation-luminance characteristic can be obtained.

Similar to the aforementioned effect, this modified example makes it possible to realize the auxiliary capacitor voltage adjuster 40 having a simple configuration and to realize an accurate adjustment.

In this modified example, since the polysilicon of the detection capacitors 26 contains an impurity at a concentration set between 1E19 atoms/$cm^3$ and 1E22 atoms/$cm^3$, the operation of the oscillator 31 can be stabilized.

Third Embodiment

Figure 17:
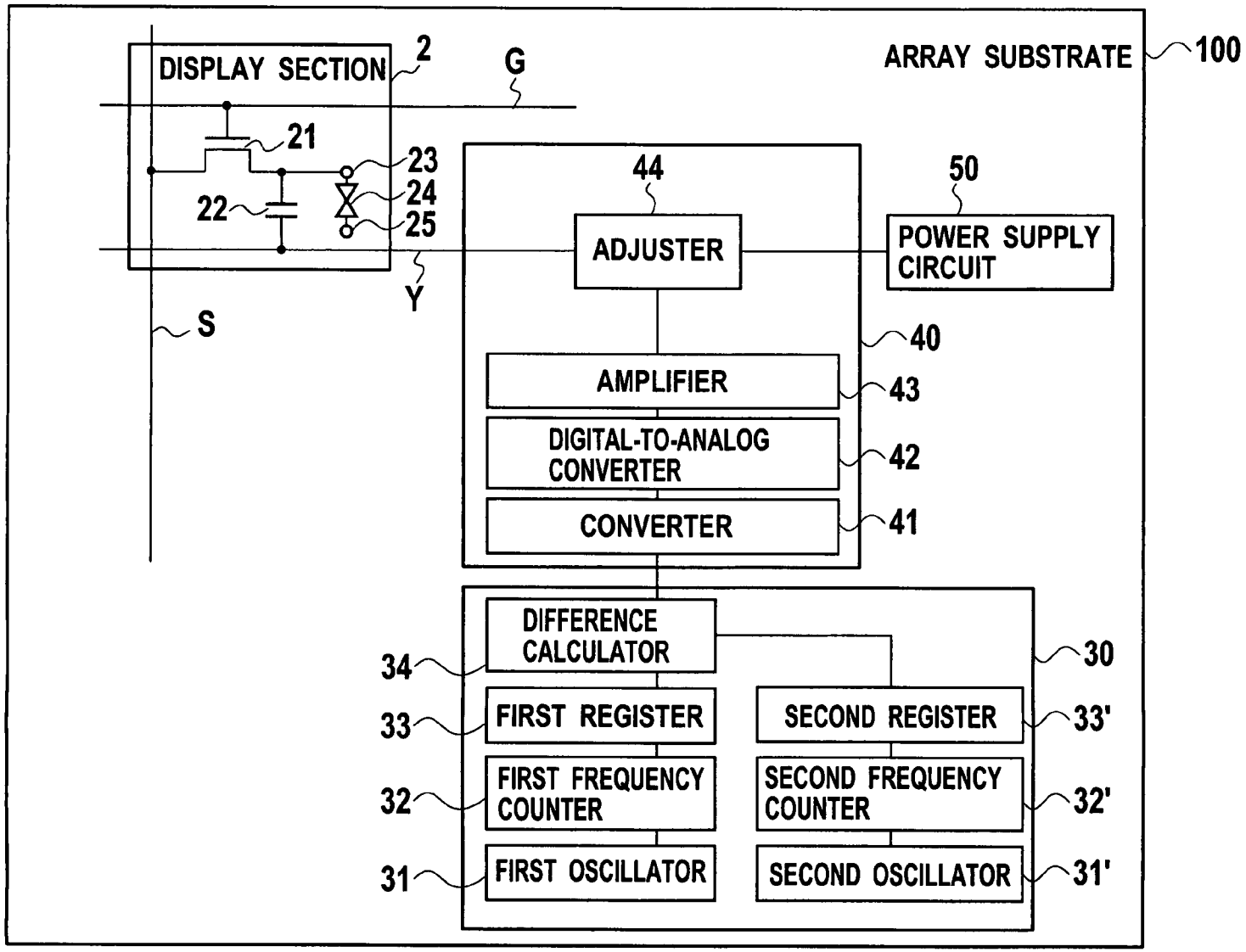
FIG. 17 shows a schematic block diagram of a liquid crystal display device of a third embodiment.

As shown in the schematic block diagram of FIG. 17, in a liquid crystal display device of a third embodiment, the auxiliary capacitor detector 30 further includes a second oscillator 31', a second frequency counter 32', a second register 33', and a difference calculator 34. Other components are similar to those of the second embodiment, and therefore will not be further described here. It should be noted that, in this embodiment, the oscillator 31, the frequency counter 32, and the register 33 of the modified example shown in FIG. 13 in the second embodiment are referred to as a first oscillator 31, a first frequency counter 32, and a first register 33, respectively.

Figure 18:
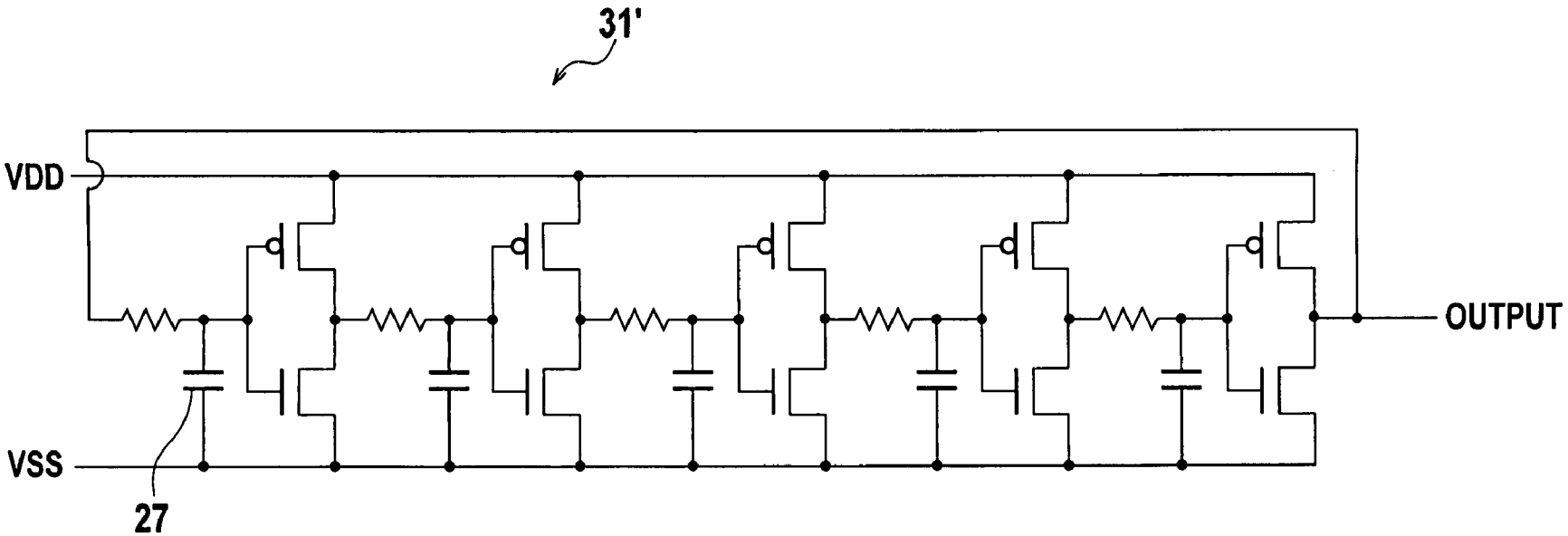
FIG. 18 shows a circuit diagram of a second oscillator.
Figure 19:
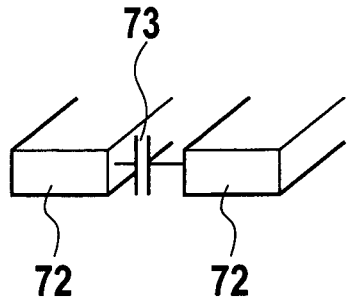
FIG. 19 is a perspective view showing one example of the structure of a reference capacitor.
Figure 20:
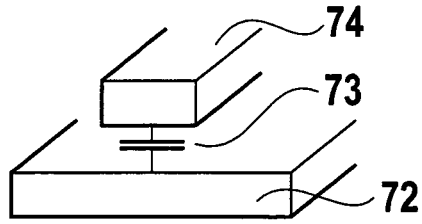
FIG. 20 is a perspective view showing another example of the structure of the reference capacitor.

FIG. 18 is a circuit diagram showing the circuit configuration of the second oscillator 31'. The configuration of the second oscillator 31' is basically the same as that of the first oscillator 31. However, the second oscillator 31' includes a reference capacitor 27 having a structure different from that of the detection capacitor 26 between the input terminal of each inverter Inv and the power supply VSS. As in the example of FIG. 19, the reference capacitor 27 has a structure in which the interlayer insulating film 73 is held between a pair of gate electrodes 72. Alternatively, the reference capacitor 27 may have a structure in which the interlayer insulating film 73 is held between a gate electrode 72 and a source/drain electrode 74.

As described in the second embodiment, variations in the film thickness of the auxiliary capacitor 22 correspond to variations in the output frequency of the first oscillator 31. However, the output frequency of the first oscillator 31 is also influenced by characteristics of the MOS thin-film transistors constituting the first oscillator 31 and other parasitic capacitors. Accordingly, in the auxiliary capacitor detector 30, the second oscillator 31' is used which includes the reference capacitors 27 having structures different from those of the detection capacitors 26, the output frequency of the second oscillator 31' is counted by the second frequency counter 32' and temporarily stored in the second register 33', and then the difference between the output frequencies of the first and second oscillators 31 and 31' is calculated by the difference calculator 34. Thus, the influence of characteristics of the thin-film transistors and the like are eliminated.

Figure 21:
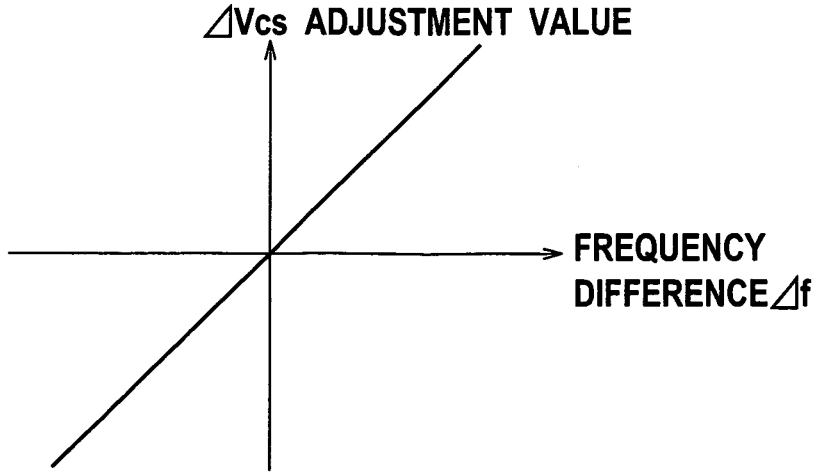
FIG. 21 is a graph showing a relationship between the frequency detected by an auxiliary capacitor detector of the third embodiment and an adjustment value for the potential amplitude of the auxiliary capacitor.

The auxiliary capacitor voltage adjuster 40 adjusts the potential amplitude of the power supply line Y connected to the auxiliary capacitor 22 by beforehand determining in a translation table a relationship between the frequency difference Δf detected by the auxiliary capacitor detector 30 and an adjustment value for the potential amplitude ΔVcs of the auxiliary capacitor 22 shown in FIG. 21. A specific method of adjusting the potential amplitude of the power supply line Y is similar to that described in the modified example of the second embodiment, and therefore will not be further described here. Moreover, the operation of other components is similar to that described in the second embodiment, and therefore will not be further described here.

It should be noted that the insulating film which is an element of the reference capacitor 27 is not limited to the interlayer insulating film 73 and that other insulating film having a known frequency can also be utilized.

In this embodiment, the difference between the output frequency of the first oscillator 31 including the detection capacitors 26 having layer structures similar to that of the auxiliary capacitor 22 and the output frequency of the second oscillator 31' including the reference capacitors 27 having structures different from those of the detection capacitors 26 is converted into an adjustment value based on a predetermined relationship. This makes it possible to adjust the potential amplitude of the power supply line Y using a frequency in which the influences of characteristics of the MOS thin-film transistors constituting the oscillator, and of other parasitic capacitors are eliminated. Thus, a more stable gradation-luminance characteristic can be obtained.

In this embodiment, by adjusting the potential amplitude ΔVcs based on a predetermined relationship between the difference between the output frequencies of the first and second oscillators 31 and 31' and an adjustment value for the potential amplitude of the auxiliary capacitor 22, the auxiliary capacitor voltage adjuster 40 having a simple configuration can be realized, and an accurate adjustment can be realized.

What is claimed is:

1. A display device comprising:

a display section comprising a switch element, an auxiliary capacitor, and a pixel electrode for each of segments bordered by a plurality of scan lines and a plurality of signal lines;

a first oscillator comprising a detection capacitor having a layer structure similar to that of the auxiliary capacitor;

a first frequency counter configured to count an output frequency of the first oscillator;

a first register configured to store the counted frequency;

a converter configured to convert the stored frequency into an adjustment value on the basis of a predetermined relationship between the output frequency of the first oscillator and an adjustment value for a potential amplitude of the auxiliary capacitor; and an adjuster configured to adjust a potential amplitude of a power supply line connected to the auxiliary capacitor based on the resultant adjustment value.

2. The display device of claim 1, wherein the first oscillator is a circuit made by cascading an odd number of inverters in a loop, each inverter comprising a thin-film transistor having the detection capacitor.

3. The display device of claim 2, further comprising:

a resistor connected between an output terminal of the inverter and an input terminal of the next inverter; and a detection capacitor placed between the input terminal of the inverter and a power supply line, the detection capacitor having a layer structure similar to that of the auxiliary capacitor.

4. The display device of claim 3, further comprising:

a second oscillator comprising an odd number of inverters cascaded in a loop, a resistor connected between an output terminal of the inverter and an input terminal of the next inverter, and a reference capacitor between the input terminal of the inverter and a power supply wire, each inverter comprising a thin-film transistor having a detection capacitance having a layer structure similar to that of the auxiliary capacitor, and the reference capacitor having a structure different from that of the detection capacitor;

a second frequency counter configured to count an output frequency of the second oscillator;

a second register configured to store the frequency counted by the second frequency counter; and a difference calculator configured to calculate a difference between the frequencies stored in the first and second registers, wherein based on a predetermined relationship between a difference between the output frequencies of the first and second oscillators and an adjustment value for the potential amplitude of the auxiliary capacitor, the converter converts the frequency difference calculated by the difference calculator into an adjustment value.

5. The display device of any one of claims 1 to 4, wherein the detection capacitor contains an impurity in a channel at a concentration of 1E19 atoms/$cm^3$ to 1E22 atoms/$cm^3$.

* * * * *